United States Patent [19]

Wiebe

[11] 4,090,750

[45] May 23, 1978

[54] RESILIENT RAILWAY TRUCK SIDE BEARING

[75] Inventor: Donald Wiebe, Sewickley, Pa.

[73] Assignee: A. Stucki Company, Pittsburgh, Pa.

[21] Appl. No.: 774,373

[22] Filed: Mar. 4, 1977

[51] Int. Cl.[2] ..... B61F 5/14; B61F 5/24; F16C 17/04; F16C 27/02

[52] U.S. Cl. ..... 308/138; 105/199 CB

[58] Field of Search ..... 105/199 CB; 267/3, 4; 308/138

[56] References Cited

U.S. PATENT DOCUMENTS

| | | | |
|---|---|---|---|
| 2,259,049 | 10/1941 | Swan et al. | 308/138 |
| 2,301,372 | 11/1942 | Cottrell | 308/138 |
| 2,327,954 | 8/1943 | Barrows et al. | 308/138 |
| 2,350,301 | 5/1944 | Cottrell | 308/138 |
| 2,698,208 | 12/1954 | Dilg | 308/138 |
| 3,719,154 | 3/1973 | Reynolds | 308/138 |
| 3,957,318 | 5/1976 | Wiebe | 105/199 CB X |

*Primary Examiner*—Drayton E. Hoffman
*Assistant Examiner*—Howard Beltran
*Attorney, Agent, or Firm*—Howard E. Sandler

[57] ABSTRACT

A railway truck side bearing and more particularly an improved side bearing assembly utilizing elastomeric means disposed within multiple abutment channels to control railway freight vehicle hunting.

7 Claims, 4 Drawing Figures

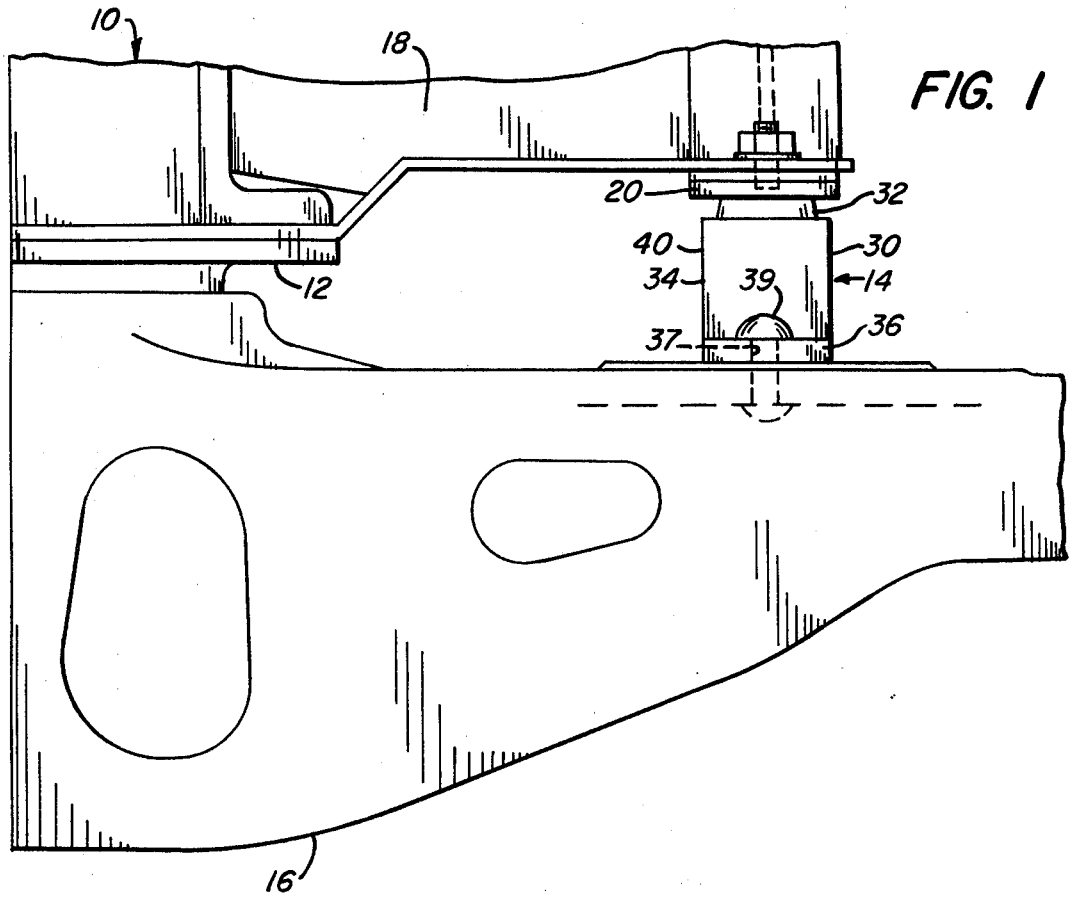
FIG. 1
FIG. 4
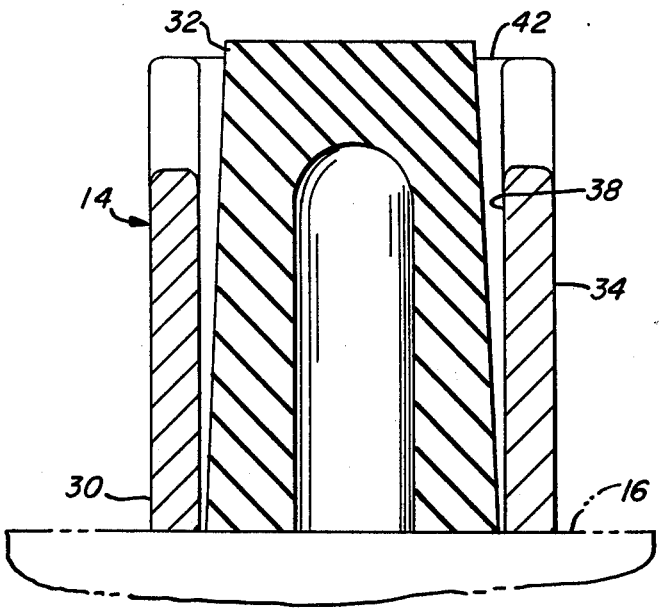

RESILIENT RAILWAY TRUCK SIDE BEARING

Hunting in railway vehicles is the unstable cyclic yawing of trucks and the resulting lateral oscillation of the railway car vehicle and is of particular significance when the car is traveling in an empty condition at relatively high speeds; for example, in excess of 45 miles per hour. The lateral track irregularities combined with conventional coned wheel configurations results in one side frame moving ahead of the other which in turn results in the flanges of the wheels striking and rubbing against the rails first on one side and then on the other thereby causing undesirable lateral car body oscillations and excessive truck component and rail wear. As the wheel treads and flanges wear, the tread conicity becomes more severe and the flange-rail clearance becomes larger thereby resulting in greater lateral excursions of the wheel sets during hunting and hence a more severe response occurs at an even lower speed. The lateral excursions can become sufficiently severe to possibly result in derailments.

Attempts were made heretofore to control hunting by utilizing resilient side bearings through frictional force obtained from a compressed or deflected resilient member. Such prior resilient side bearings consisted of either spring loaded steel elements or elastomeric blocks or columns or a combination of both. The spring loaded steel elements which utilize a steel on steel friction interface to control hunting quickly proved to be ineffective because of seizing and gulling thereby creating dangerously high shear forces having a potential to cause the truck to derail on curved track. On the other hand the elastomeric blocks offer the advantage of controlled friction at the side bearing interface, precluding seizing and creating a less rigid shear constraint which permits the truck to negotiate a minor lateral track irregularity without breaking friction at the side bearing-wear plate interface.

The elastomeric blocks utilized heretofore which were sufficiently resilient for the preload compression, which is necessary to obtain consistent and reliable vertical biasing forces, subject to decomposition from internal heating and were generally too soft in shear to effectively restrain the truck for hunting control. If such elastomeric blocks were made sufficiently stiff in shear to control hunting they would be generally so stiff in compression that they would cause excessive weight transfer or concentration on one given side bearing thereby resulting in an excessive friction force restraining the truck from swiveling in a manner to cause a derailment on short radius curved track.

The above mentioned problems of resilient side bearings to control hunting have been recognized and substantially corrected in applicant's inventions described in U.S. Pat. No. 3,957,318 issued May 18, 1976, and U.S. application Ser. No. 732,021 filed Oct. 13, 1976 and assigned to the same assignee as is this invention. Some embodiments of these prior applications described a unitary roller side bearing assembly having elastomeric means disposed in the bearing channel intermediate the ends thereof and a roller bearing to alleviate the above-mentioned problems due to hunting while simultaneously providing means for swiveling of the truck with respect to the car body as well as limiting the elastomer deformation under all extremely high side bearing load conditions. Furthermore, the inventions utilized elastomeric bearing means having an upper portion comprised of an elastomer having properties to frictionally restrain the car body from hunting and a lower portion adapted to be captively restrained and supported in a rigid cage and comprised of an elastomer being sufficiently resilient for preload compression necessary to obtain a consistent and reliable vertical biasing force while not being subject to heat decomposition. Other embodiments illustrated in the above-mentioned application and patent included elastomeric bearing means within a confining channel, without the presence of a roller bearing.

While the invention described in the above-mentioned application and patent have been found adequate to control hunting, the elastomeric bearing means is rigidly restrained in all instances only at the axial ends of the retaining channel. Inasmuch as the compression stiffness at the abutment determines the requisite shear stiffness of the block necessary to control hunting, an arrangement of rigid restraint only at axial ends of the retaining channels necessitates an extremely high bearing block shear stiffness, particularly in instances of utilization with heavier light cars (i.e. eighty to ninety thousand pounds) to control hunting. Thus, in certain circumstances for example the particular instances of heavier light cars, the control of hunting with elastomeric bearing blocks is extremely difficult because of the inability of industry to develop materials which have sufficient compression modulus to maintain shear stiffness consistent with hunting control.

By means of the present invention which includes a multicavity member designed to receive a plurality of elastomeric side bearings therewithin, an arrangement is created wherein th reaction to the transverse hunting force is divided among a plurality of rigid faces. Thus, in instances of a two cavity side bearing, the transverse hunting force at each respective abutment, is one half of the abutment reaction of a receiving channel or member of the above mentioned application and patent. Accordingly, by use of the present invention one can utilize an elastomeric side bearing having a lower shear stiffness than was possible hereinbefore while better ensuring control of severe hunting. Furthermore, with an arrangement of the present invention, the column heighth of the elastomeric column may be increased somewhat thereby enlarging the selection of materials which can be used to accommodate maximum bearing deflections in given parameters.

It is to be recognized that in utilizing the invention herein in the particular embodiments described hereinafter, the roller side bearing structure or structures utilizing a flexibly restrained rigid load bearing element are not used. This will result in more rigid truck swivel restraint under high side bearing load conditions when elastomeric elements are fully deflected and the load transfers to the top of the side bearing assembly. Accordingly, although a flexible restrained load bearing element may on some occasions be more desirable at severe side bearing apllications, truck side bearings in the form of rigid friction blocks have proven workable in prior freight car designs.

These and other objects and advantages will become more readily apparent upon a reading of the following description and drawings in which:

FIG. 1 is a partial schematic and side elevational view of a railway car assembly having a side bearing assembly constructed according to the principles of the present invention disposed intermediate the car body and truck bolster;

FIG. 4 is a transverse cross-sectional view taken on lines 4—4 of FIG. 3.

Figure 2:
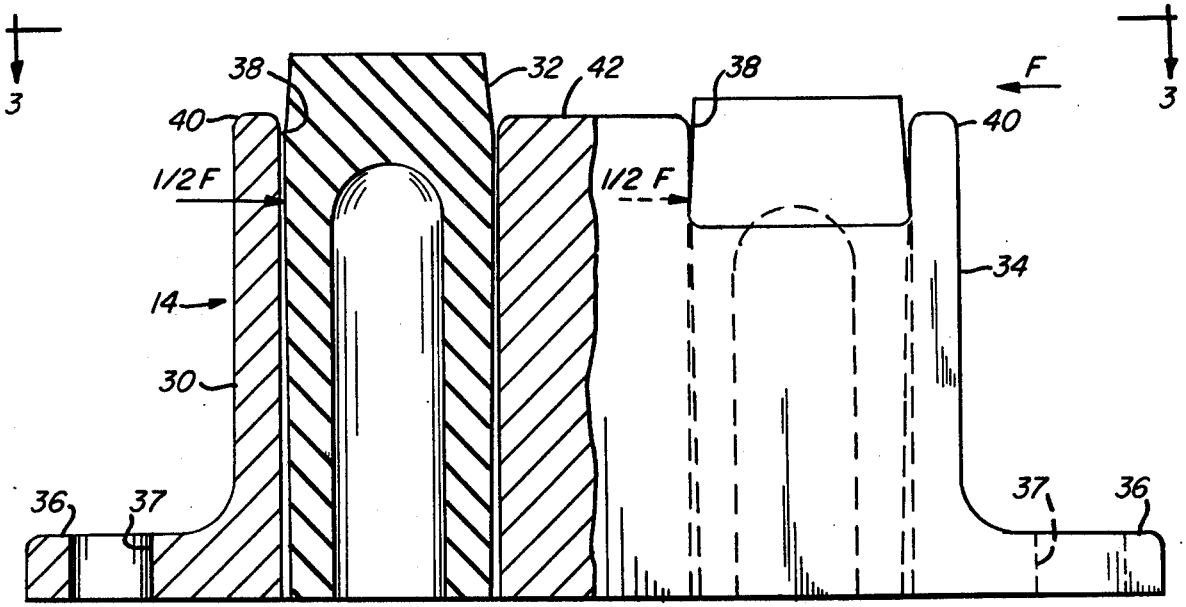
FIG. 2 is a longitudinal view, partly in section, of the side bearing assembly illustrated in FIG. 1.

FIG. 1 illustrates a fragmentary portion of a four-wheel railway freight car assembly, generally illustrated at 10, comprising; a center plate 12 and side bearing assemblies 14 of the present invention which cooperate with a bolster 16 to support the car body 18. Well known spring groups are mounted in a pair of side frames (not shown) to support the bolster 16. Suitably journaled wheels which rest on tracks (not shown) support each side frame in a well known manner. Wear plates 20 are carried by car body 18 for engagement with each side bearing 14.

Inasmuch as the invention herein is primarily directed to side bearing assemblies 14 and the balance of the elements set forth hereinabove are well known in the art further description of such elements will not be set forth hereinafter except where necessary to describe side bearing 14.

Side bearing assembly 14 comprises: an elongated main body member 30 adapted to receive a plurality of elastomeric bearing blocks 32 therewithin in a manner as described hereinafter. Body member 30 includes an upstanding control bearing block receiving portion 34. A pair of longitudinally spaced connecting flanges 36 are integrally formed with portion 34 adjacent the lower end thereof and extend outwardly therefrom along the longitudinal axis of assembly 14. Each flange 36 includes a vertically extending bore 37 therethrough. In assembled position a suitable fastener such as a rivet or bolt 39 is received within each bore 37 to secure the side bearings 14 to the bolster 16 in a manner that the longitudinal extent of side bearings 14 extend transversely of the longitudinal extent of bolster 16.

Figure 3:
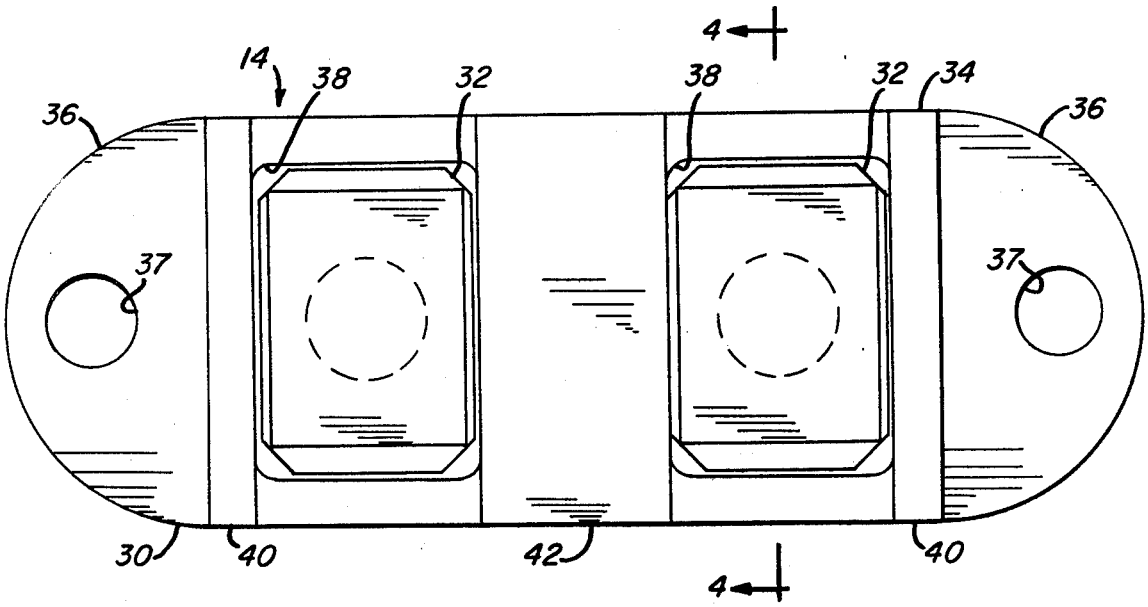
FIG. 3 is a plan view taken on line 3—3 of FIG. 2.

As illustrated, control portion 34 additionally includes a pair of longitudinally spaced vertically extending polygonal bearing block receiving openings 38 therethrough. Openings 38 may be of any suitable periphery which mates with the outer periphery of respective bearing blocks 32 and as illustrated in FIG. 3 are of a generally rectangular configuration with the long sides thereof extending in a direction transverse to the longitudinal extent of side bearing assembly 14. Openings 38 may be viewed as separating control portion 34 into a pair of axially spaced vertically extending end abutments 40 and a vertically extending central abutment 42 axially intermediate end abutments.

As shown, each vertically elongated bearing block 32 is formed of an elastomeric material and has a generally rectangular configuration. In assembled position the bearing blocks 32 are each positioned within a respective opening 38. Inasmuch as openings 38 extend through the control portion 34, the lowermost ends of bearing blocks 32 are seated directly on the adjacent upper surface of bolster 16. This direct seating on the upper surface of bolster 16 greatly facilitates the casting of main body member 30 as well as permits a direct cushioned transfer of side bearing vertical loads from the car body 18 to the bolster 16.

The left hand elastomeric bearing block 32 in FIG. 2 is exemplary of a block 32 received within an opening 38 and seated on bolster 16 with no load being applied thereto. In this condition it is seen in FIG. 2 that a slight clearance exists between the adjacent transversely extending surfaces of the block 32 and the abutments 40 and 42. Also it is seen in FIG. 2 that a block 32 tapers slightly downwardly and inwardly from a point in the left hand block 32, adjacent the uppermost surfaces of abutments 40 and 42 and also tapers slightly upwardly and inwardly from such point.

The right hand portion of FIG. 2 illustrates a block 32 statically deflected by the car body 18 is supported on the bolster 16. As can be seen in this latter-mentioned portion of FIG. 2, the column of the block 32 is compressed, the point of intersection on the upwardly and downwardly tapering portions of block 32 is now slightly below the uppermost surfaces of abutments 40 and 42 and the area around this intersection now tightly engages the rigid vertical abutments 40 and 42. In instances when the railway car is operating on uneven track and rocking from one side to the other, the above-mentioned point of intersection of tapers the block 32 may at such times be slightly higher or lower than is illustrated in the right hand side of FIG. 2 but still in firm engagement with adjacent surfaces of abutments 40 and 42.

Insofar as hunting control, the operation of side bearing assembly 14 and the deformation characteristics of the blocks 32 are essentially identical to the characteristics described in detail heretofore in U.S. Pat. No. 3,957,318, with the primary distinction therebetween being that in the particular embodiment described, horizontal forces "F" are applied in a longitudinal direction, as the car starts to hunt, for example to the left as seen in FIG. 2, is now registered by a one-half "F" force at the left end abutment 40 and a second one-half "F" force at the central abutment 42. In other words the total shear stiffness of each block 32 need only be one half of the shear stiffness required to resist a similar force applied to a prior art side bearing having a single elastomeric bearing disposed in a cage or a plurality of elastomeric bearings having roller bearings or longitudinally unrestrained elements disposed therebetween. Sufficiently rigid longitudinal constraint of the block 32 is necessary in order to achieve truck hunting control at higher freight car speeds. Accordingly, it is contemplated that in no instance should the free height of block 32 above the upper surface of abutments 40 and 42 exceed twenty percent (20%) of the total or free height of the block 32 and preferably should not exceed ten percent (10%).

Specifically, the blocks 32 will deform in shear in a plane longitudinal to the extent of side bearing 14 near the top of the blocks 32 and in compression at the vertical abutment contact point of each block 32 when the railway car is traveling at a high speed and hunting or oscillating in a horizontal plane. The contact between the bearing block 32 and the wear plate 20 is maintained by frictional engagement throughout the normal operation of the freight car on a straight or gradually curved track, which are the primary areas of concern with respect to hunting thereby effectively controlling hunting within acceptable limits. In other words, blocks 32 prevent hunting by providing a sufficiently rigid shearing constraint at the side bearings within a predetermined acceptable modulus of elasticity while still maintaining an ability of the blocks 32 to compress vertically for dynamic and preload conditions. With these parameters it is readily understood that by now utilizing the multiple abutment arrangement of applicant's invention, the upper limit of the rigid shear constraint or shear modulus is now reduced, thereby conveniently reducing the compression modulus to ensure operation and material integrity and improved control where hunting is to be expected.

In the patent and application discussed hereinbefore, embodiments were described wherein single elastomeric bearing blocks were molded of two different materials in order to provide an upper portion having a stiffness in shear to provide hunting while still maintaining an ability of the elastomeric blocks to compress vertically for dynamic and preload conditions. By means of applicant's invention, in many instances this requirement of molding of two differing materials may be eliminated since the required shear stiffness is now reduced by two (or by three, four or more if even more rigid abutments and blocks are used), thus better permitting the selection of an optimum material which will suffice for both of these conditions. Furthermore, in the event conditions still necessitate a bearing block 32 be molded from two different materials, then the reduction of maximum required shear stiffness as taught by the instant invention will allow for a more reasonable selection of materials.

When the freight car 10 is rocking the blocks 32 will deform further and the wear plates 20 will be in direct communication with the uppermost surfaces of abutments 40 and 42. In the event truck swivel is required during such severe loading, the time of frictional engagement between wear plate 20 and abutments 40 and 42 is small and will only momentarily inhibit such swivel in the particular embodiment illustrated; however, it is proposed that such swivel restraint is a slight tradeoff in instances where potentially severe hunting control is desired in conjunction with a compact economical device. To further reduce this frictional swivel restraint it will be noted that the sides of openings 38 which extend normal to abutments 40 and 42 have the uppermost surfaces thereof spaced downwardly from the uppermost surfaces of abutments 40 and 42 thereby reducing the metal to metal contact area in instances of engagement of wear plates 20 with the respective body member 30. If this swivel restraint is unacceptable in certain applications then other modifications may certainly be made to the preferred embodiment illustrated, for example: smooth machining and hardening of the upper surface of abutments 40 and 42; coating or impregnating the upper surface of abutments 40 and 42 with a frictional type material disposing small roller bearings within abutment surfaces 40 and 42; and the like.

In addition to the modifications discussed hereinbefore other modifications can be made to the preferred embodiment described hereinabove without departing from the scope of the invention, for example: a plurality of more than two elastomeric bearing blocks 32 and respective longitudinally spaced openings 38 are contemplated; receiving openings 38 may be formed as pockets rather than through openings; the configuration of bearing blocks 32 and respective openings 38 may be altered; body member 30 may be intergrally formed with bolster 16 or as a weldment thereto; and the like.

What is claimed is:

1. A railway vehicle side bearing assembly adapted to be disposed intermediate a bolster and car body of a railway vehicle comprising: a generally horizontally elongated main body member: a plurality of generally vertically extending upwardly open longitudinally spaced retaining means formed within said body member; elastomeric bearing means received within each of said retaining means; each of said bearing means having a generally horizontally extending planer uppermost surface which is adapted to engage a respective generally planer horizontally extending surface of such a car body for the control of railway vehicle hunting by frictional restraint; said uppermost surface of said bearing means being vertically spaced upwardly from the uppermost surface of said body member when said bearing means are in the natural relaxed state thereof and when first vertical loadings are directed to such a side bearing; and each of said retaining means having a pair of longitudinally spaced immovable rigid abutment surfaces adapted to engage adjacent portions of the respective bearing means received therewithin downwardly adjacent the upper surface of said body member.

2. A side bearing assembly as specified in claim 1 wherein said side bearing means are loosely received within said retaining means when said bearing means are in said natural relaxed state.

3. A side bearing assembly as specified in claim 2 wherein said adjacent portions of said bearing means engage said abutment surfaces when such first loadings and subsequent loadings are directed to such a side bearing.

4. A side bearing assembly as specified in claim 1 wherein said retaining means extend vertically through said body member and in operational position said upper surface of said bearing means engage such a car body and the lower surface of said bearing means engage such a bolster.

5. A side bearing assembly as specified in claim 1 wherein said pair of retaining means comprises two longitudinally spaced retaining means.

6. A side bearing assembly as specified in claim 1 wherein each of said bearing means is formed of a single elastomeric material.

7. A side bearing assembly as specified in claim 1 wherein said body member and retaining means are integrally formed.

* * * * *